US008608266B2

(12) United States Patent
Sumiyoshi

(10) Patent No.: US 8,608,266 B2
(45) Date of Patent: Dec. 17, 2013

(54) RECORDING APPARATUS AND RECORDING METHOD

(75) Inventor: Yuta Sumiyoshi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 52 days.

(21) Appl. No.: 13/214,840

(22) Filed: Aug. 22, 2011

(65) Prior Publication Data

US 2012/0044288 A1 Feb. 23, 2012

(30) Foreign Application Priority Data

Aug. 23, 2010 (JP) ..... 2010-186498

(51) Int. Cl.
*B41J 29/38* (2006.01)
*B41J 2/045* (2006.01)

(52) U.S. Cl.
USPC ..... 347/10; 347/68

(58) Field of Classification Search
None
See application file for complete search history.

(56) References Cited

U.S. PATENT DOCUMENTS 7,585,036 B2 * 9/2009 Usui ..... 347/10

FOREIGN PATENT DOCUMENTS

JP 2007-237527 A 9/2007

* cited by examiner

*Primary Examiner* — Geoffrey Mruk
(74) *Attorney, Agent, or Firm* — Birch, Stewart, Kolasch & Birch, LLP

(57) ABSTRACT

A recording apparatus drives a recording element to perform recording on a recording medium. The recording apparatus includes: a drive waveform data acquisition device configured to acquire drive waveform data which contain waveform value information for a plurality of predetermined periods of time of a drive waveform for driving the recording element and contain identification information of the drive waveform data embedded in at least two pieces of the waveform value information; an identification information analysis device configured to extract the identification information from the drive waveform data and to interpret the extracted identification information; a waveform generation device configured to receive the waveform value information for each of the predetermined periods of time of the drive waveform data and to generate the drive waveform according to the received waveform value information, the waveform value information for the predetermined periods of time of the drive waveform data being sequentially inputted to the waveform generation device; and a drive device configured to drive the recording element according to the drive waveform generated by the waveform generation device.

11 Claims, 11 Drawing Sheets

FIG. 7

| | DATA | CONTENT OF DATA |
|---|---|---|
| 0 | 0x80 | ID DATA |
| 1 | 0x20 | WAVEFORM VALUE DATA |
| 2 | 0x20 | |
| 3 | 0x20 | |
| ⋮ | ⋮ | |
| 99 | 0x20 | |
| 100 | 0x80 | ID DATA |
| 101 | 0x20 | WAVEFORM VALUE DATA |
| ⋮ | ⋮ | |
| 199 | 0x25 | |
| 200 | 0x80 | ID DATA |
| 201 | 0x26 | WAVEFORM VALUE DATA |
| ⋮ | ⋮ | |
| 299 | 0xdf | |
| 300 | 0x80 | ID DATA |
| 301 | 0xdf | WAVEFORM VALUE DATA |
| ⋮ | ⋮ | |
| 1022 | 0x20 | WAVEFORM VALUE DATA |
| 1023 | 0x80 | ID DATA |

FIG. 12A

| | DATA | CONTENT OF DATA |
|---|---|---|
| 0 | 0x80 | ID DATA |
| 1 | 0x20 | WAVEFORM VALUE DATA |
| 2 | 0x20 | |
| 3 | 0x20 | |
| ..... | ..... | |
| 99 | 0x20 | |
| 100 | 0x80 | ID DATA |
| 101 | 0x22 | WAVEFORM VALUE DATA |
| ..... | ..... | |
| 1022 | 0x20 | WAVEFORM VALUE DATA |
| 1023 | 0x80 | ID DATA |

FIG. 12B

| | DATA | CONTENT OF DATA |
|---|---|---|
| 0 | 0x20 | REPRODUCED DATA |
| 1 | 0x20 | WAVEFORM VALUE DATA |
| 2 | 0x20 | |
| 3 | 0x20 | |
| ..... | ..... | |
| 99 | 0x20 | |
| 100 | 0x21 | REPRODUCED DATA |
| 101 | 0x22 | WAVEFORM VALUE DATA |
| ..... | ..... | |
| 1022 | 0x20 | WAVEFORM VALUE DATA |
| 1023 | 0x20 | REPRODUCED DATA |

RECORDING APPARATUS AND RECORDING METHOD

BACKGROUND OF THE INVENTION

1. Field of the Invention

The present invention relates to a recording apparatus and a recording method, more particularly to a technique of embedding identification data in drive waveform data.

2. Description of the Related Art

In printing by an inkjet method, a system is known in which waveform data is transferred to a print head control board from outside and a drive waveform applied to an actuator is generated at the print head control board according to a definition of the waveform data.

In a system such as described above, there may be cases where waveform data that differs from a desired color is inadvertently transferred due to human error or cases where waveform data transfer fails due to noise or device malfunction. In such a case, a problem occurs in that the print head control board holds inaccurate waveform data such as waveform data of a different color or waveform data during transfer failure and, as a result, an abnormal drive waveform is generated. To avoid such problems related to data transfer, additional information is connected to waveform data, and the waveform data is managed with the additional information.

Japanese Patent Application Publication No. 2007-237527 discloses a technique in which gradation data (corresponding to one line) and a header indicating a color of the gradation data and the number of bits of the gradation data are added to each piece of print data, and by interpreting the header by an analyzing unit inside a printer, a generated drive waveform is determined. According to this technique, printing can be executed even when print data with gradation information that differs for each color is included.

However, the technique disclosed in Japanese Patent Application Publication No. 2007-237527 disadvantageously requires a data capacity corresponding to the addition of the header. Furthermore, even though the header data enables recognition of a waveform, the header data alone does not enable verification of the data subsequent to the header. Therefore, it is not possible to verify whether all data has been successfully transferred. Consequently, inaccurate printing may be executed when data transfer fails and may subject an ejecting unit to an abnormal load and create paper waste.

In addition, a method of compressing waveform data and adding header data is conceivable as a countermeasure for verifying whether data transfer has been successfully performed without increasing data volume. However, in this case, there is a disadvantage in that processing becomes complicated.

SUMMARY OF THE INVENTION

The present invention has been contrived in view of these circumstances, an object thereof being to provide a recording apparatus and a recording method which recognize a drive waveform without increasing data volume and data throughput.

In order to attain the aforementioned object, the present invention is directed to a recording apparatus configured to drive a recording element to perform recording on a recording medium, the recording apparatus comprising: a drive waveform data acquisition device configured to acquire drive waveform data which contain waveform value information for a plurality of predetermined periods of time of a drive waveform for driving the recording element and contain identification information of the drive waveform data embedded in at least two pieces of the waveform value information; an identification information analysis device configured to extract the identification information from the drive waveform data and to interpret the extracted identification information; a waveform generation device configured to receive the waveform value information for each of the predetermined periods of time of the drive waveform data and to generate the drive waveform according to the received waveform value information, the waveform value information for the predetermined periods of time of the drive waveform data being sequentially inputted to the waveform generation device; and a drive device configured to drive the recording element according to the drive waveform generated by the waveform generation device.

According to this aspect of the present invention, the drive waveform data which contain the waveform value information for the predetermined periods of time of the drive waveform for driving the recording element and contain the identification information thereof embedded in at least two pieces of the waveform value information are acquired, the identification information is extracted from the drive waveform data, and the extracted identification information is interpreted. Thus, the drive waveform can be recognized without increasing data volume and data throughput.

Preferably, the identification information is embedded in at least first and last pieces of the waveform value information.

According to this aspect of the present invention, the drive waveform can be recognized more appropriately.

Preferably, the identification information represents a value different from a bias value of the waveform value information.

According to this aspect of the present invention, the drive waveform can be recognized more appropriately.

Preferably, the recording apparatus further comprises: a judgment device configured to judge, in accordance with an analysis result by the identification information analysis device, whether the acquired drive waveform data is normal; and a notification device configured to notify, when the verification device judges that the acquired drive waveform data is not normal, a user that the acquired drive waveform data is not normal.

According to this aspect of the present invention, the user can be informed when the drive waveform data is not normal.

Preferably, the judgment device includes an error detection device configured to perform error detection according to the identification information.

According to this aspect of the present invention, the judgment can be appropriately made on whether or not the acquired drive waveform data is normal.

Preferably, the recording apparatus further comprises: a plurality of recording elements corresponding respectively to colors to be recorded, wherein: the identification information includes color information of each of the recording elements for which the drive waveform data are prepared; and the drive device drives each of the recording elements according to the color information interpreted by the identification information analysis device.

According to this aspect of the present invention, the drive waveform corresponding to the recording element of each color can be used.

Preferably, the identification information includes version information of the drive waveform data.

According to this aspect of the present invention, the version of the drive waveform data can be recognized.

Preferably, the waveform generation device has an output response characteristic in which the identification information is not reflected in the generated drive waveform.

According to this aspect of the present invention, the drive waveform can be generated regardless of the presence of the identification information.

Preferably, the recording apparatus further comprises a correction device which corrects the drive waveform data in order to absorb manufacturing variation of the recording element.

According to this aspect of the present invention, the manufacturing variation of the recording element can be absorbed.

Preferably, the recording apparatus further comprises a reproduction device which reproduces waveform value information prior to embedment of the identification information.

According to this aspect of the present invention, the drive waveform can be appropriately generated even when the response speed of the waveform generation device is high.

In order to attain the aforementioned object, the present invention is also directed to a recording method of driving a recording element to perform recording on a recording medium, the method comprising the steps of: acquiring drive waveform data which contain waveform value information for a plurality of predetermined periods of time of a drive waveform for driving the recording element and contain identification information of the drive waveform data embedded in at least two pieces of the waveform value information; extracting the identification information from the drive waveform data, and interpreting the extracted identification information; sequentially inputting the waveform value information for the predetermined periods of time of the drive waveform data to a waveform generation device, and generating the drive waveform by the waveform generation device according to the inputted waveform value information for each of the predetermined periods of time of the drive waveform data; and driving the recording element according to the drive waveform generated by the waveform generation device.

According to the present invention, the drive waveform can be recognized without increasing data volume and data throughput.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 7 is a diagram showing a data configuration of drive waveform data for generating a drive waveform;

FIGS. 12A and 12B are diagrams showing a data configuration of drive waveform data before and after ID data interpolation.

DETAILED DESCRIPTION OF THE PREFERRED EMBODIMENTS

Composition of Inkjet Image Forming Apparatus

Figure 1:
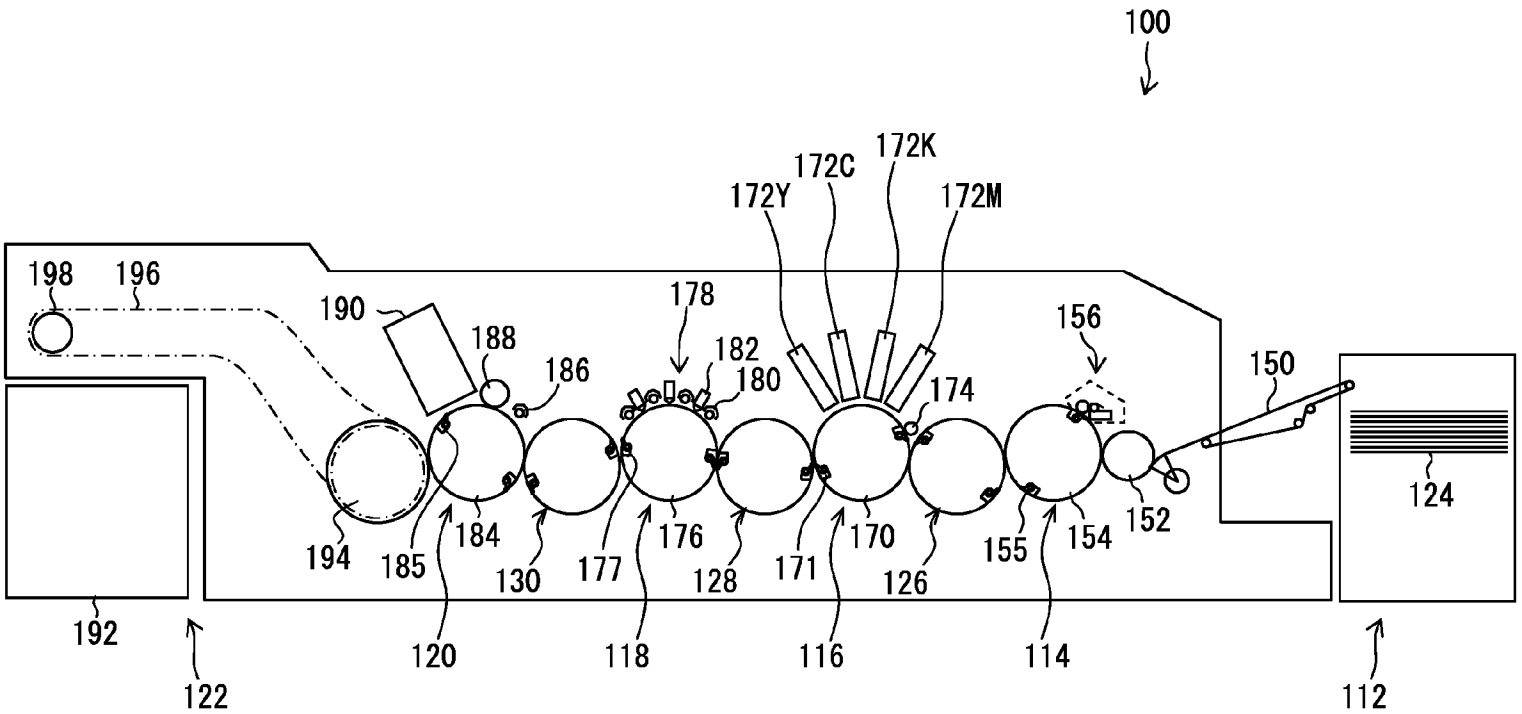
FIG. 1 is an entire structural diagram illustrating the configuration of an inkjet image forming apparatus.

FIG. 1 is a structural diagram illustrating the configuration of an inkjet image forming apparatus 100 according to an embodiment of the present invention. The inkjet image forming apparatus 100 includes a paper feed unit 112, a treatment liquid deposition unit (pre-coating unit) 114, an image formation unit 116, a drying unit 118, a fixing unit 120, and a paper output unit 122 as the main components.

The inkjet image forming apparatus 100 is of a single-pass system which forms a desired color image on a recording medium (hereinafter also referred to as "paper") 124 held on a pressure drum (an image formation drum 170) of an image formation unit 116 by ejecting and depositing droplets of ink of a plurality of colors from inkjet heads 172M, 172K, 172C and 172Y onto the recording medium 124, and is of an on-demand type which adapts a two-liquids reaction (aggregation in the present embodiment) system in which treatment liquid (aggregation treatment liquid in the present embodiment) is deposited onto the recording medium 124 prior to the deposition of the ink, so that the deposited ink reacts with the treatment liquid to form images on the recording medium 124.

<Paper Feed Unit>

The recording media (e.g., paper sheets) 124 are stacked in the paper feed unit 112. The paper feed unit 112 is provided with a paper feed tray 150, and feeds the recording media 124, sheet by sheet, through the paper feed tray 150 to the treatment liquid deposition unit 114. It is possible to use recording media of different types and various sizes as the recording media 124. A mode can be adopted in which the paper feed unit 112 is provided with a plurality of paper trays (not illustrated) in which recording media of different types are respectively sorted and stacked, and the paper that is fed to the paper feed tray 150 from the paper trays is automatically switched, and a mode can also be adopted in which an operator selects or exchanges the paper tray in accordance with requirements. In the present embodiment, cut sheets of paper are used as the recording media 124, but it is also possible to cut paper to a required size from a continuous roll of paper and then supply this cut sheet of the paper.

<Treatment Liquid Deposition Unit>

The treatment liquid deposition unit 114 is a mechanism that deposits the treatment liquid onto the recording surface of the recording medium 124. The treatment liquid includes a coloring material aggregating agent that causes the aggregation of a coloring material (pigment in the present embodiment) contained in the ink to be deposited in the image formation unit 116, and the separation of the coloring material and a solvent in the ink is enhanced when the treatment liquid is brought into contact with the ink.

The treatment liquid deposition unit 114 includes a paper transfer drum 152, a treatment liquid drum (referred also to as a "pre-coating drum") 154, and a treatment liquid application device 156. The treatment liquid drum 154 is a drum that holds and rotationally conveys the recording medium 124. The treatment liquid drum 154 is provided on the outer circumferential surface thereof with a hook-shaped holding device (gripper) 155, which holds the leading end of the recording medium 124 by gripping the recording medium 124 between the hook of the gripper 155 and the circumferential surface of the treatment liquid drum 154. The treatment liquid drum 154 can be provided with suction apertures on the outer circumferential surface thereof and connected to a suction device that performs suction through the suction apertures. As a result, the recording medium 124 can be tightly held on the outer circumferential surface of the treatment liquid drum 154.

The treatment liquid application device 156 is disposed on the outside of the treatment liquid drum 154 opposite the outer circumferential surface thereof. The treatment liquid application device 156 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 124 that is held by the treatment liquid drum 154, so as to transfer the treatment liquid metered by the anilox roller to the recording medium 124. The treatment liquid application device 156 can apply the treatment liquid onto the recording medium 124 while metering.

In the present embodiment, the application system using the roller is employed; however, the present invention is not limited to this, and it is possible to employ a spraying method, an inkjet method, or other methods of various types.

The recording medium 124 on which the treatment liquid has been deposited in the treatment liquid deposition unit 114 is transferred from the treatment liquid drum 154 through the intermediate conveyance unit 126 to the image formation drum 170 of the image formation unit 116.

<Image Formation Unit>

The image formation unit 116 includes the image formation drum (referred also to as a "jetting drum") 170, a paper pressing roller 174 and the inkjet heads 172M, 172K, 172C and 172Y. Similar to the treatment liquid drum 154, the image formation drum 170 is provided on the outer circumferential surface thereof with a hook-shaped holding device (gripper) 171. The recording medium 124 held on the image formation drum 170 is conveyed in a state where the recording surface thereof faces outward, and inks are deposited onto the recording surface by the inkjet heads 172M, 172K, 172C and 172Y.

The inkjet heads 172M, 172K, 172C and 172Y are recording heads (inkjet heads) of the inkjet system of the full line type that have a length corresponding to the maximum width of the image formation region in the recording medium 124. Rows of nozzles (two-dimensionally arranged nozzles) are formed on the ink ejection surface of the inkjet head. Each nozzle row has a plurality of nozzles arranged therein for discharging ink over the entire width of the image recording region. Each of the inkjet heads 172M, 172K, 172C and 172Y is fixedly disposed so as to extend in the direction perpendicular to the conveyance direction (rotation direction of the image formation drum 170) of the recording medium 124.

The image formation drum 170 is provided with an encoder (not shown) to measure a rotational speed of the image formation drum 170. Ejection timings of the inkjet heads 172M, 172K, 172C and 172Y are controlled according to data obtained with the encoder, and thereby the ejected droplets can be precisely deposited on the recording medium 124.

Droplets of corresponding colored inks are ejected from the inkjet heads 172M, 172K, 172C and 172Y toward the recording surface of the recording medium 124 held tightly on the image formation drum 170, and thereby the ink comes into contact with the treatment liquid that has been heretofore deposited on the recording surface by the treatment liquid deposition unit 114, the coloring material (pigment) dispersed in the ink is aggregated, and a coloring material aggregate is formed. Thus, the coloring material flow on the recording medium 124 is prevented, and an image is formed on the recording surface of the recording medium 124.

In the present embodiment, the MKCY standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

The recording medium 124 on which the image has been formed in the image formation unit 116 is transferred from the image formation drum 170 through an intermediate conveyance unit 128 to a drying drum 176 of the drying unit 118.

<Drying Unit>

The drying unit 118 dries water included in the solvent separated by the coloring material aggregation action. As shown in FIG. 1, the drying unit includes the drying drum 176 and a solvent dryer 178.

Similar to the treatment liquid drum 154, the drying drum 176 is provided on the outer circumferential surface thereof with a hook-shaped holding device (gripper) 177, which can hold the recording medium 124 by gripping the leading end portion of the recording medium 124.

The solvent dryer 178 is disposed in a position facing the outer circumferential surface of the drying drum 176, and includes a plurality of halogen heaters 180, and a plurality of warm-air blow-out nozzles 182, each of which is arranged between adjacent two of the halogen heaters 180.

Each of the warm-air blow-out nozzles 182 is controlled to blow warm air at appropriate temperature at an appropriate blowing rate toward the recording medium 124, and each of the halogen heaters 180 is controlled to appropriate temperature, and it is thereby possible to implement various drying conditions.

The surface temperature of the drying drum 176 is set to 50° C. or above. By heating from the rear side of the recording medium 124, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176 (namely, preventing burns due to high temperature), desirably, the surface temperature of the drying drum 176 is not higher than 75° C. (and more desirably, not higher than 60° C.).

By holding the recording medium 124 in such a manner that the recording surface thereof is facing outward on the outer circumferential surface of the drying drum 176 (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

The recording medium 124 which has been subjected to the drying treatment in the drying unit 118 is transferred from the drying drum 176 through an intermediate conveyance unit 130 to a fixing drum 184 of the fixing unit 120.

<Fixing Unit>

The fixing unit 120 includes the fixing drum 184, a halogen heater 186, a fixing roller 188, and an in-line sensor 190. Similar to the treatment liquid drum 154, the fixing drum 184 is provided on the outer circumferential surface thereof with a hook-shaped holding device (gripper) 185, which can hold the recording medium 124 by gripping the leading end portion of the recording medium 124.

The recording medium 124 is conveyed by rotation of the fixing drum 184 in a state where the recording surface thereof faces outward, and the preheating by the halogen heater 186, the fixing treatment by the fixing roller 188 and the inspection by the in-line sensor 190 are performed with respect to the recording surface.

The halogen heater 186 is controlled to a prescribed temperature (for example, 180° C.), by which the preheating is performed with respect to the recording medium 124.

The fixing roller 188 is a roller member which applies pressure and heat to the dried ink to melt and fix the self-dispersible polymer particles in the ink so as to transform the ink into the film. The fixing roller 188 is configured so as to apply pressure and heat to the recording medium 124. More specifically, the fixing roller 188 is arranged so as to be pressed against the fixing drum 184, and a nip roller is configured between the fixing roller 188 and the fixing drum 184. As a result, the recording medium 124 is squeezed between the fixing roller 188 and the fixing drum 184, nipped under a prescribed nip pressure (for example, 0.15 MPa), and subjected to fixing treatment.

Further, the fixing roller 188 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 124 is heated with the heating roller, thermal energy not lower than a Tg temperature (glass transition temperature) of a latex included in the ink is applied and latex particles are melted. As a result, fixing is performed by penetration into the projections-recessions of the recording medium 124, the projections-recessions of the image surface are leveled out, and gloss is obtained.

The fixing unit 120 in the embodiment shown in FIG. 1 is provided with the single fixing roller 188; however, it is possible that the fixing roller 188 has a configuration provided with a plurality of steps, dependently on the thickness of image layer and Tg characteristic of latex particles.

On the other hand, the in-line sensor 190 is a measuring device which measures the ejection failure check pattern, moisture amount, surface temperature, gloss, and the like of the image (including a test pattern, and the like) recorded on the recording medium 124. A CCD sensor or the like can be used for the in-line sensor 190.

With the fixing unit 120 of the above-described configuration, the latex particles located within a thin image layer formed in the drying unit 118 are melted by application of pressure and heat by the fixing roller 188. Thus, the latex particles can be reliably fixed to the recording medium 124. The surface temperature of the fixing drum 184 is set to 50° C. or above. Drying is promoted by heating the recording medium 124 held on the outer circumferential surface of the fixing drum 184 from the rear side, and therefore breaking of the image during fixing can be prevented, and furthermore, the strength of the image can be increased by the effects of the increased temperature of the image.

It is possible to use an ink containing a monomer component that can be polymerized and cured when irradiated with ultraviolet (UV) light, instead of the ink containing the high-boiling point solvent and the polymer particles (thermoplastic resin particles). In this case, the inkjet image formation apparatus 100 is provided with a UV irradiation unit to irradiate the ink having been deposited on the recording medium 124 with UV light, instead of the heat-pressure fixing unit having the heat roller (the fixing roller 188). If using an ink containing an active light-curable resin, such as a UV-curable resin, instead of the ink containing the thermoplastic resin particles, then the inkjet image formation apparatus 100 is thus provided with a device which irradiates the active light, such as a UV lamp or a UV laser diode (LD) array, instead of the fixing roller 188 for heat fixing.

<Paper Output Unit>

As shown in FIG. 1, the paper output unit 122 is arranged after the fixing unit 120. The paper output unit 122 includes a paper output tray 192. A transfer drum 194, a pair of endless conveyance belts 196, and a tension roller 198 are arranged between the fixing drum 184 of the fixing unit 120 and the paper output tray 192, so as to face the fixing drum 184 and the paper output tray 192. The recording medium 124 is conveyed through the transfer drum 194 to the conveyance belts 196, and is then outputted to the paper output tray 192.

Although detailed composition of the paper conveyance mechanism with the conveyance belts 196 is not shown in the drawings, the recording medium 124 on which the image has formed is transferred while the leading end thereof is held with grippers arranged on a bar (not shown) connecting the pair of endless conveyance belts 196, to a position over the paper output tray 192 by the rotation of the conveyance belts 196.

Although not illustrated in FIG. 1, the inkjet image forming apparatus 100 of the present embodiment includes, in addition to the configuration described above: an ink storing/loading unit for supplying the inks to the inkjet heads 172M, 172K, 172C and 172Y; a device for supplying treatment liquid to the treatment liquid deposition unit 114; a head maintenance unit for cleaning the inkjet heads 172M, 172K, 172C and 172Y (wiping the nozzle surface, purging, suctioning the nozzles, etc.); a position determination sensor for determining the position of the recording medium 124 on a paper conveyance path; and a temperature sensor for measuring the temperature of each of the units arranged in the apparatus.

Embodiments of Structure of Inkjet Head

Next, the structure of inkjet heads is described. The respective inkjet heads 172M, 172K, 172C and 172Y have the same structure, and any of the recording heads is hereinafter referred to as a head 250.

Figure 2A:
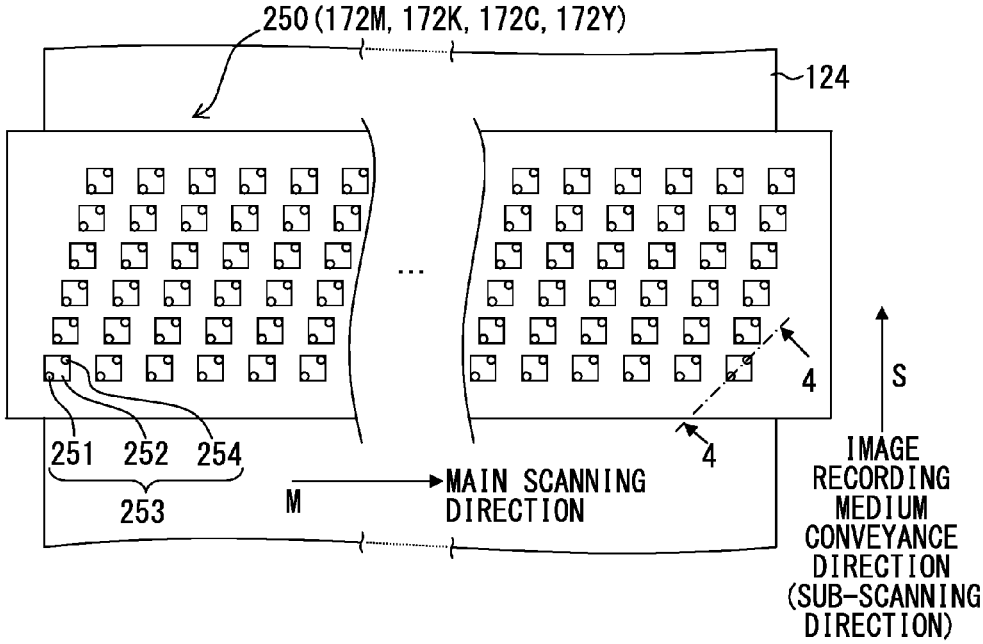
FIGS. 2A and 2B are plan perspective diagrams illustrating an embodiment of the structure of a recording head.
Figure 2B:
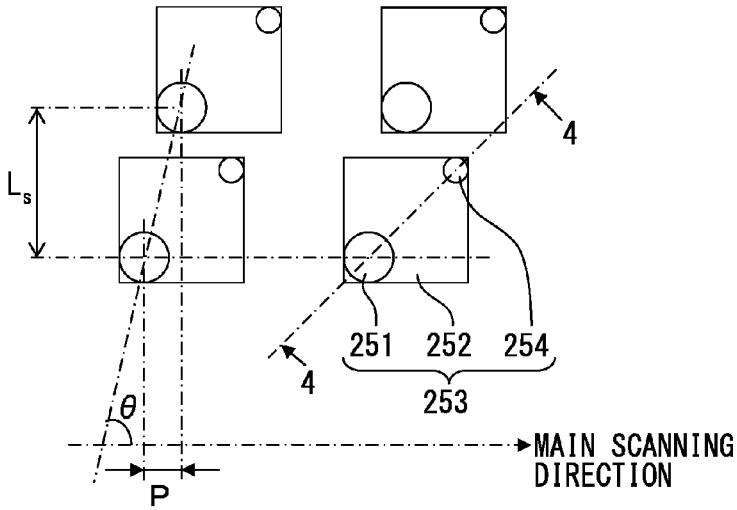
Figure 3A:
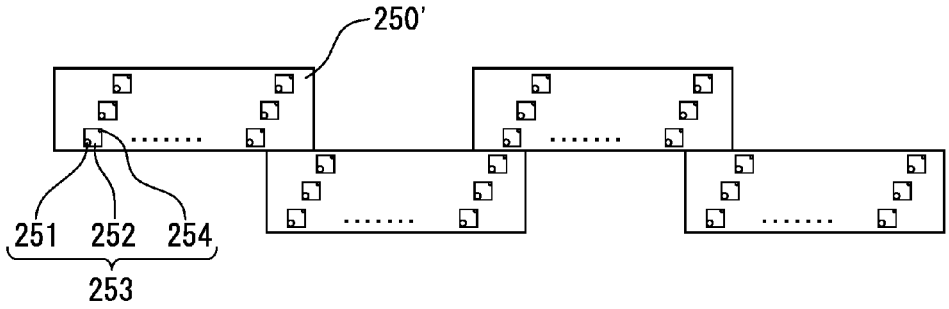
FIGS. 3A and 3B are plan perspective diagrams illustrating other embodiments of the structure of the recording head.
Figure 3B:
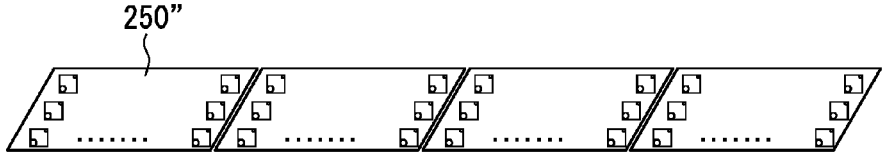
Figure 4:
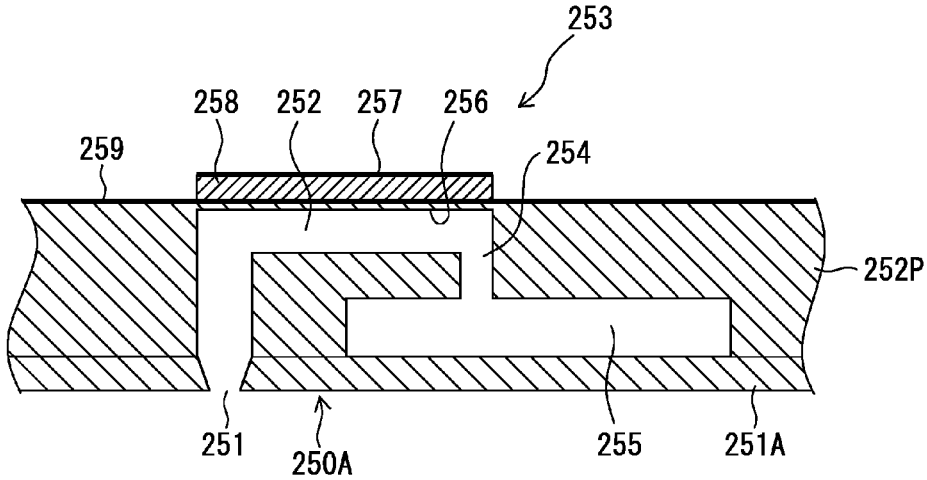
FIG. 4 is a cross-sectional diagram illustrating the inner configuration of a droplet ejection element.

FIG. 2A is a plan perspective diagram illustrating an embodiment of the structure of the head 250, and FIG. 2B is a partial enlarged diagram of same. Moreover, FIGS. 3A and 3B are planar perspective views illustrating other structural embodiments of heads, and FIG. 4 is a cross-sectional diagram illustrating a liquid droplet ejection element for one channel being a recording element unit (an ink chamber unit corresponding to one nozzle 251) (a cross-sectional diagram along line 4-4 in FIGS. 2A and 2B).

As illustrated in FIGS. 2A and 2B, the head 250 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographicallyprojected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium 124 in a direction (direction indicated by arrow M) substantially perpendicular to the paper conveyance direction (direction indicated by arrow S) of the recording medium 124 is not limited to the embodiment described above. For example, instead of the configuration in FIG. 2A, as illustrated in FIG. 3A, a line head having nozzle rows of a length corresponding to the entire width Wm of the recording area of the recording medium 124 can be formed by arranging and combining, in a staggered matrix, short head modules 250' having a plurality of nozzles 251 arrayed in a two-dimensional fashion. It is also possible to arrange and combine short head modules 250" in a line as shown in FIG. 3B.

The nozzle rows required for image formation in a prescribed image formation region can be formed not only for the entire surface of the recording medium 124 taken as an image formation range, but also for only part of the surface of the recording medium 124 constituting the image formation region (i.e., when a non-image formation region (blank space) is provided in the circumference of the sheet).

The pressure chamber 252 provided to each nozzle 251 has substantially a square planar shape (see FIGS. 2A and 2B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 4, the head 250 is configured by stacking and joining together a nozzle plate 251A, in which the nozzles 251 are formed, a flow channel plate 252P, in which the pressure chambers 252 and the flow channels including the common flow channel 255 are formed, and the like. The nozzle plate 251A constitutes a nozzle surface (ink ejection surface) 250A of the head 250 and has formed therein the two-dimensionally arranged nozzles 251 communicating respectively to the pressure chambers 252.

The flow channel plate 252P constitutes lateral side wall parts of the pressure chamber 252 and serves as a flow channel formation member, which forms the supply port 254 as a limiting part (the narrowest part) of the individual supply channel leading the ink from a common flow channel 255 to the pressure chamber 252. FIG. 4 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 4) of the pressure chamber 252. The diaphragm 256 in the present embodiment is made of silicon (Si) having a nickel (Ni) conductive layer serving as a common electrode 259 corresponding to lower electrodes of a plurality of piezoelectric actuators 258, and also serves as the common electrode of the piezoelectric actuators 258, which are disposed on the respective pressure chambers 252. The diaphragm 256 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied between the individual electrode 257 and the common electrode 259, the piezoelectric actuator 258 is deformed, the volume of the pressure chamber 252 is thereby changed, and the pressure in the pressure chamber 252 is thereby changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 2B, the plurality of ink chamber units 253 having the above-described structure are arranged in a prescribed matrix arrangement pattern in a line direction along the main scanning direction and a column direction oblique at an angle of θ with respect to the main scanning direction, and thereby the high density nozzle head is formed in the present embodiment. In this matrix arrangement, the nozzles 251 can be regarded to be equivalent to those substantially arranged linearly at a fixed pitch $P=Ls/\tan\theta$ along the main scanning direction, where Ls is a distance between the nozzles adjacent in the sub-scanning direction.

In implementing the present invention, the mode of arrangement of the nozzles 251 in the head 250 is not limited to the embodiments in the drawings, and various nozzle arrangement structures can be employed. For example, instead of the matrix arrangement as described in FIGS. 2A and 2B, it is also possible to use an undulating nozzle arrangement, such as a V-shaped nozzle arrangement, or zigzag configuration (W-shape arrangement), which repeats units of V-shaped nozzle arrangements.

The devices which generate pressure (ejection energy) applied to eject droplets from the nozzles in the inkjet head is not limited to the piezoelectric actuator (piezoelectric elements), and can employ various pressure generation devices (energy generation devices), such as heaters in a thermal system (which uses the pressure resulting from film boiling by the heat of the heaters to eject ink) and various actuators in other systems. According to the ejection system employed in the head, the corresponding energy generation devices are arranged in the flow channel structure body.

<Description of Control System>

Figure 5:
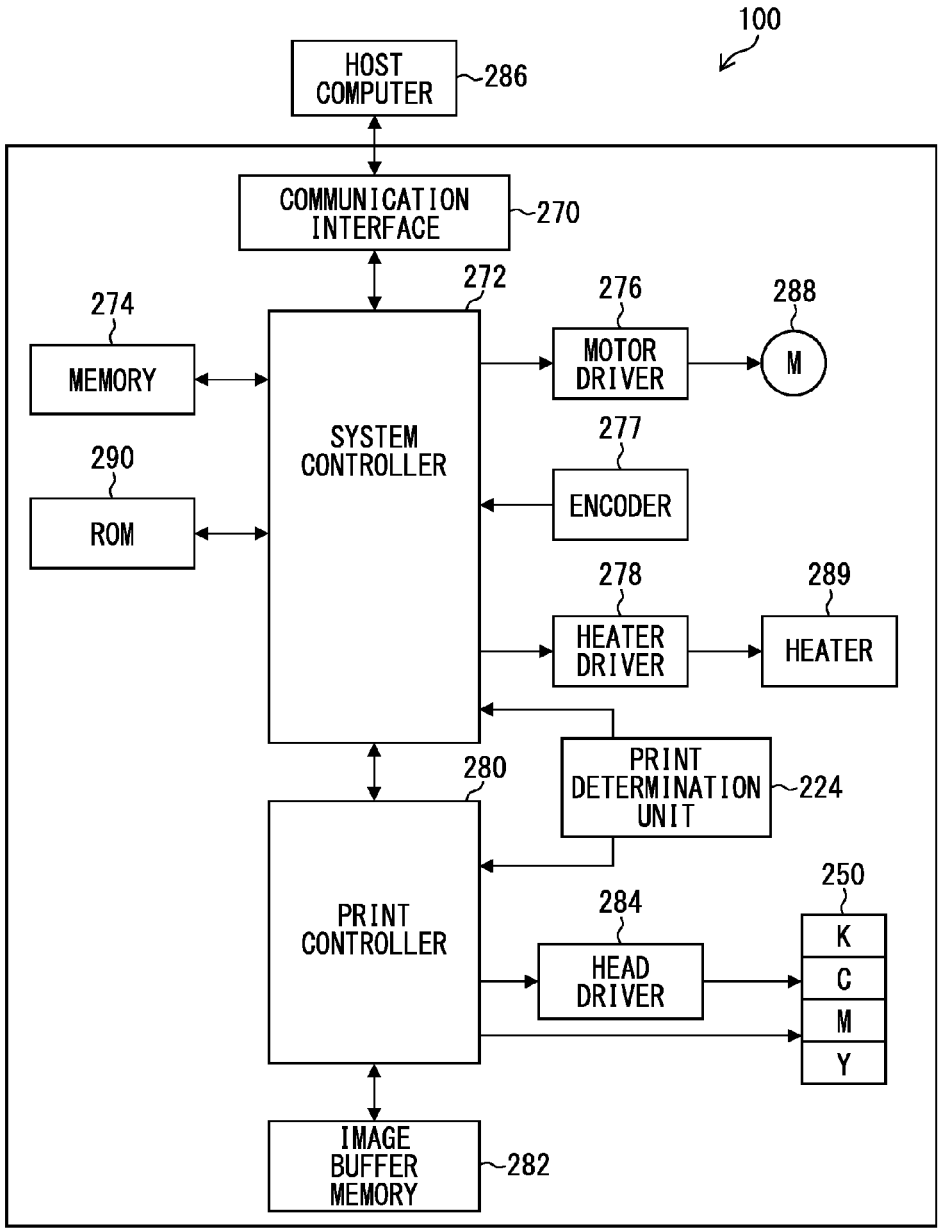
FIG. 5 is a block diagram showing the main system configuration of the inkjet image forming apparatus.

FIG. 5 is a block diagram showing the main system configuration of the inkjet image forming apparatus 100. The inkjet image forming apparatus 100 includes a communication interface 270, a system controller 272, a memory 274, a motor driver 276, a heater driver 278, a print controller 280, an image buffer memory 282, a head driver 284, a ROM 290, a print determination unit 224, an encoder 277, and the like.

The communication interface 270 is an interface unit for receiving image data sent from a host computer 286. A serial interface such as CAN (Controller Area Network), USB (Universal Serial Bus), IEEE1394, Ethernet (registered trademark), and wireless network, or a parallel interface such as a Centronics interface may be used as the communication interface 270. A buffer memory (not shown) may be mounted in this portion in order to increase the communication speed. The image data sent from the host computer 286 is received by the inkjet image forming apparatus 100 through the communication interface 270, and is temporarily stored in the memory 274.

The memory 274 is a storage device for temporarily storing images inputted through the communication interface 270, and data is written and read to and from the image memory 274 through the system controller 272. The memory 274 is not limited to a memory composed of semiconductor elements, and a hard disk drive or another magnetic medium may be used.

The system controller 272 is constituted of a central processing unit (CPU) and peripheral circuits thereof, and the like, and it functions as a control device for controlling the whole of the inkjet image forming apparatus 100 in accordance with a prescribed program, as well as a calculation device for performing various calculations. More specifically, the system controller 272 controls the various sections, such as the communication interface 270, memory 274, motor driver 276, heater driver 278, and the like, as well as controlling communications with the host computer 286 and writing and reading to and from the memory 274, and it also generates control signals for controlling the motor 288 and heater 289 of the conveyance system.

The ROM 290 stores various control programs and parameters, and the programs are read out and executed in accordance with commands from the system controller 272.

The memory 274 is used as a temporary storage region for the image data, and it is also used as a program development region and a calculation work region for the CPU.

The motor driver 276 drives the motor 288 in accordance with commands from the system controller 272. In FIG. 5, the motors arranged in the various sections in the inkjet image forming apparatus 100 are collectively denoted with the reference numeral 288.

The heater driver 278 drives the heater 289 in accordance with commands from the system controller 272. In FIG. 5, the heaters arranged in the various sections in the inkjet image forming apparatus 100 are collectively denoted with the reference numeral 289.

The print controller 280 is a control unit which has signal processing functions for performing various treatment processes, corrections, and the like, in accordance with the control implemented by the system controller 272, in order to generate a signal for controlling the image formation from the image data in the memory 274, and supplies the image formation data (dot image data) thus generated to the head driver 284.

In general, the dot image data is generated by subjecting the image data to color conversion processing and halftone processing. The color conversion processing is processing for converting image data represented by an sRGB system (e.g., 8-bit image data for each of the colors of R, G and B) for instance, into image data (the MKCY color data in the present embodiment) of the respective colors of ink used by the inkjet image forming apparatus 100.

The halftone processing is processing for converting the color data of the respective colors generated by the color conversion processing into dot data of respective colors (the MKCY dot data in the present embodiment) by error diffusion processing, a threshold value matrix method, or the like.

Prescribed signal processing is carried out in the print controller 280, and the ejection amount and the ejection timing of the ink droplets from the inkjet heads 250 are controlled through the head driver 284, on the basis of the obtained print data. Thus, prescribed dot size and dot positions can be achieved.

The print controller 280 is provided with the image buffer memory 282, and image data, parameters, and other data are temporarily stored in the image buffer memory 282 when image data is processed in the print controller 280. A mode is also possible in which the print controller 280 and the system controller 272 are integrated to form a single processor.

The head driver 284 can include a feedback control system for maintaining constant drive conditions in the head 250.

The inkjet image forming apparatus 100 of the present embodiment adopts a drive system in which the ink is ejected from the nozzles 251 corresponding to the piezoelectric actuators 258 by applying a common drive electric power waveform signal to the piezoelectric actuators 258 in the head 250 while turning on/off switch elements (not shown) connected to the individual electrodes of the piezoelectric actuators 258 in accordance with the ejection timing of the respective piezoelectric actuators 258.

The print determination unit 244 is a functional block which reads in the image printed on the recording medium 124 by each of the inkjet heads 172M, 172K, 172C and 172Y, performs various signal processing operations for the read data, and the like, and supplies subscribed information to the system controller 272. The print determination unit 244 includes the in-line sensor 190 shown in FIG. 1.

The encoder 277 is to measure the rotational speed of the image formation drum 170. For example, a photoelectric rotary encoder is used as the encoder 277. The system controller 272 calculates the rotational speed of the image formation drum 170 from a signal obtained by the encoder 277, generates ejection timing signals of the nozzles 251 of the inkjet heads 172M, 172K, 172C and 172Y of the respective colors on the basis of the calculated rotational speed, and supplies the ejection timing signals to the print controller 280. The print controller 280 counts a prescribed number of pulse delays and generates an encoder signal of the fixing drum 184 shown in FIG. 1.

It is possible that the processing functions of the system controller 272 described with reference to FIG. 5 are entirely or partially performed by the host computer 286.

Figure 6:
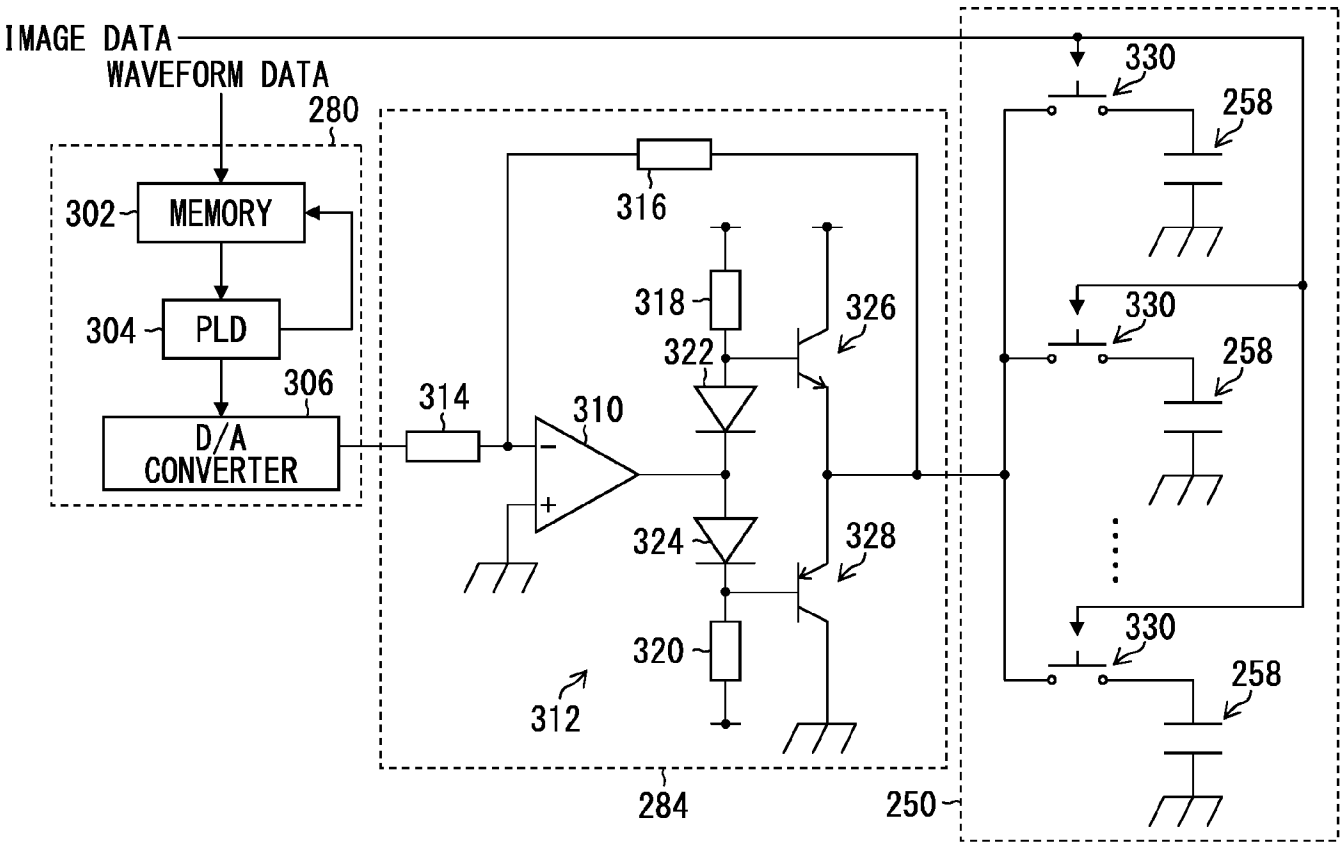
FIG. 6 is a diagram showing configuration details of respective parts of a print controller 280, a head driver 284, and a head 250.

FIG. 6 is a diagram showing configuration details of the print controller 280, the head driver 284 and the head 250 shown in FIG. 5.

The print controller 280 includes a memory 302, a programmable logic device (PLD) 304, and a digital/analog (D/A) converter 306. The memory 302 stores drive waveform data for driving the piezoelectric actuators 258. The drive waveform data is sequentially read by the PLD 304 and converted into an analog signal by the D/A converter 306.

The head driver 284 includes an operational amplifier 310 and a boost circuit 312. The boost circuit 312 includes: a push-pull circuit, which is constituted of two push-pull-connected power transistors 326 and 328; a bias circuit, which is constituted of resistors 318 and 320 and diodes 322 and 324 and converts an output signal of the operational amplifier 310 into a bias signal (input signal) of the boost circuit 312; and a feedback circuit, which is constituted of resistors 314 and 316.

The analog signal outputted from the D/A converter 306 of the print controller 280 is inputted to and amplified by the operational amplifier 310 of the head driver 284. The signal amplified by the operational amplifier 310 is power-amplified by the boost circuit 312 to enable a large output current necessary for driving the piezoelectric actuators 258 to be supplied.

Switching elements 330 are connected respectively to individual electrodes of the piezoelectric actuators 258 of the head 250. The output of the boost circuit 312 is connected to the individual electrodes of the piezoelectric actuators 258 through the switching elements 330.

The switching elements 330 are turned on and off by image data (dot data) generated by the print controller 280.

By turning each switching element 330 on and off according to an ejection timing of a drive waveform inputted to the switching elements 330, ink can be ejected from the nozzle 251 corresponding to each piezoelectric actuator 258.

Moreover, in a case where the piezoelectric actuators 258 of the heads 250 corresponding to the colors are respectively driven by different drive waveforms, the print controller 280 and the head driver 284 may be provided for each color.

First Embodiment

Next, the drive waveform data according to a first embodiment of the present invention is described.

Figure 8:
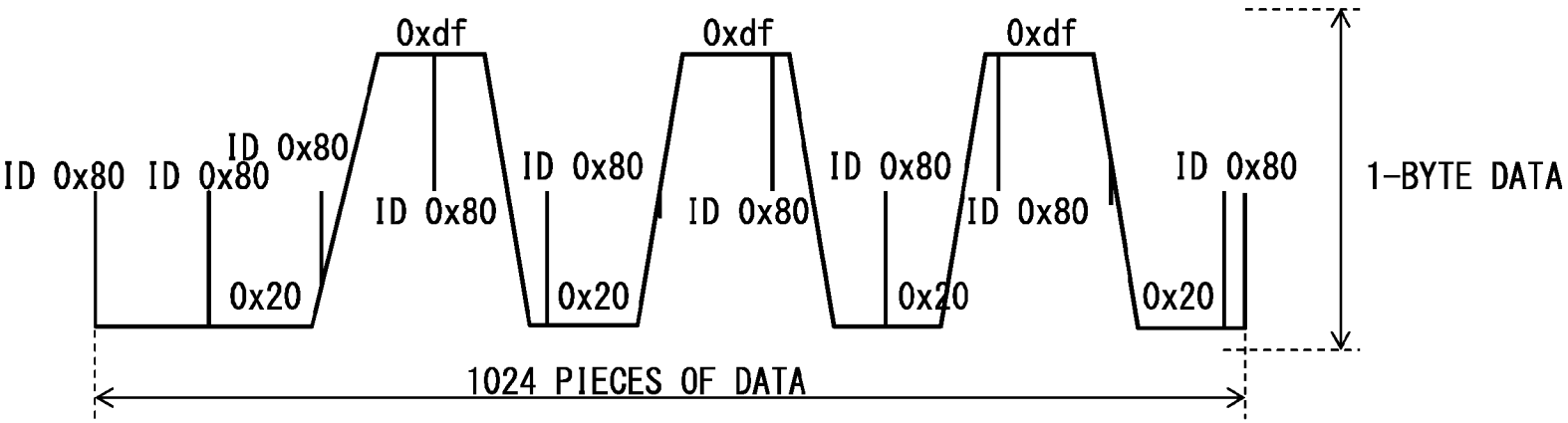
FIG. 8 is a diagram showing a time chart in which respective addresses of drive waveform data are set as a time axis.

FIG. 7 is a diagram showing a data configuration of the drive waveform data for generating the drive waveform according to the present embodiment, and FIG. 8 is a diagram showing a time chart of the drive waveform data.

As shown in FIGS. 7 and 8, the drive waveform data is constituted of 1024 pieces of data each indicating waveform value information for each predetermined period of time of the drive waveform. Each datum or piece of data is expressed by one byte. Here, a bias value of the drive waveform is expressed as "0x20" and a maximum value of the drive waveform is expressed as "0xdf".

Moreover, ID data of the drive waveform is embedded at predetermined intervals in the drive waveform data. The ID data contains color information unique to each color of ink, and is expressed by one byte. Furthermore, a value different from the bias value (in the present embodiment, 0x20) of the drive waveform (the waveform value information) is used.

For example, values such as C=0x80, M=0x81, Y=0x82, and K=0x83 are set for the ID data. The values of the ID data need only differ from the bias value of the drive waveform and are not limited to these examples.

In the present embodiment, the ID data is embedded at a head and a tail of the drive waveform data, as well as at every 100 pieces of data from the head of the drive waveform data. More specifically, "0x80", which is the ID data of the present drive waveform data for cyan is recorded at 0th, 100th, 200th, . . . , 900th, 1000th, and 1023rd pieces of data from the head of the drive waveform data.

The ID data may contain version information of the drive waveform data instead of the color information. Moreover, the ID data may contain a combination of the color information and the version information.

Figure 9:
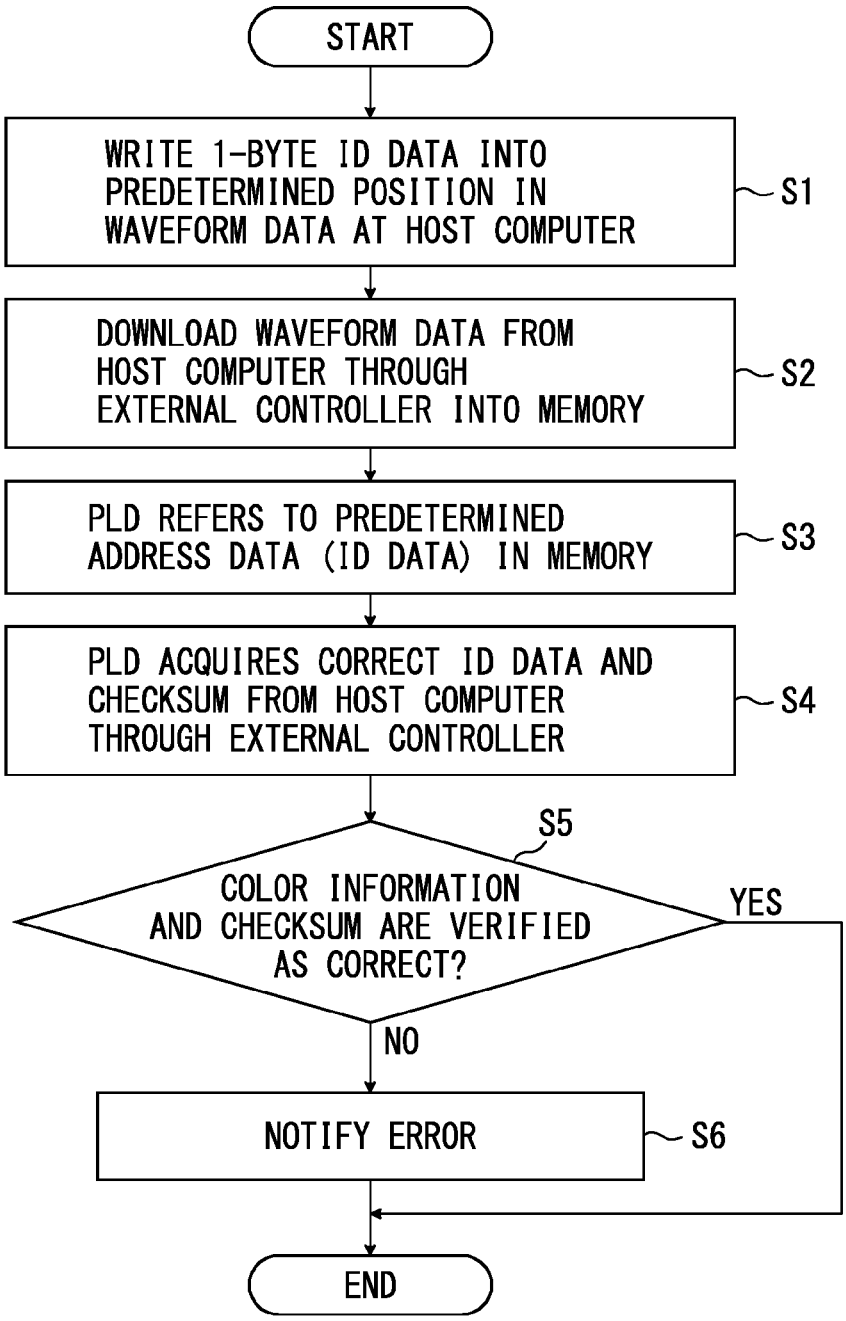
FIG. 9 is a flow chart showing processing for transferring drive waveform data.

Next, processing for acquiring the drive waveform data is described. FIG. 9 is a flow chart showing processing for transferring the drive waveform data.

First, at the host computer 286, the ID data of one byte is written into the predetermined positions in the drive waveform data to be transferred (step S1). In this case, as shown in FIG. 7, the ID data is written to the head and the tail of the drive waveform data, as well as at every 100 pieces of the drive waveform data from the head of the drive waveform data. The ID data may be written over the waveform value information that already exists at each of the predetermined positions.

Next, the host computer 286 transfers (or uploads) the drive waveform data to the memory 302 of the print controller 280 through the communication interface 270 (step S2).

The PLD 304 reads out the data (ID data) from the predetermined position of the drive waveform data transferred (downloaded) to the memory 302 (step S3). A position where the PLD 304 reads out the data among the drive waveform data is determined in advance. In this case, 0th, 100th, 200th, . . . , 900th, 1000th, and 1023rd pieces of the drive waveform data from the head of the drive waveform data are read out.

Then, the PLD 304 acquires correct ID data and a correct checksum from the host computer 286 through the communication interface 270 (step S4). Instead of acquiring the correct ID data and the correct checksum from the host computer 286, the correct ID data and the correct checksum may be stored in advance in a reference memory which the print controller 280 is provided with.

Subsequently, the PLD 304 performs color information verification and recomputes the checksum based on the respective pieces of ID data read out from the drive waveform data stored in the memory 302. By comparing the results thereof with the correct ID data and the correct checksum acquired from the host computer 286, a judgment is made on whether or not the color information and the checksum are correct (step S5).

When the results are correct, it is then confirmed that the acquisition of correct drive waveform data has been completed, and the processing is finished. An incorrect result means that the acquisition of correct drive waveform data has failed. Therefore, the fact that the result is incorrect is notified to the host computer 286 and processing is finished (step S6). When this notification is sent, the host computer 286 notifies the user by displaying or the like that an error has occurred during the transmission of the drive waveform data. In this case, the user may retry the processing for transferring the drive waveform data from the beginning.

The notification to the user to the effect that the error has occurred may be directly issued by the inkjet image forming apparatus 100 instead of by the host computer 286.

As described above, by performing the verification of the checksum using the read ID data, a determination can be made as to whether the data transfer has been successful or not. The method of error detection is not limited to using the checksum and other methods may be used.

It is sufficient that the ID data is embedded at only the head and the tail of the drive waveform data (in this case, the 0th and 1023rd pieces of data). The ID data at these two locations enables verification that all drive waveform data has been transferred and that the drive waveform data has been successfully transferred. In addition, when embedding the ID data also at other positions, the positions need not be limited to every 100th piece of data as described in the present embodiment.

Figure 10:
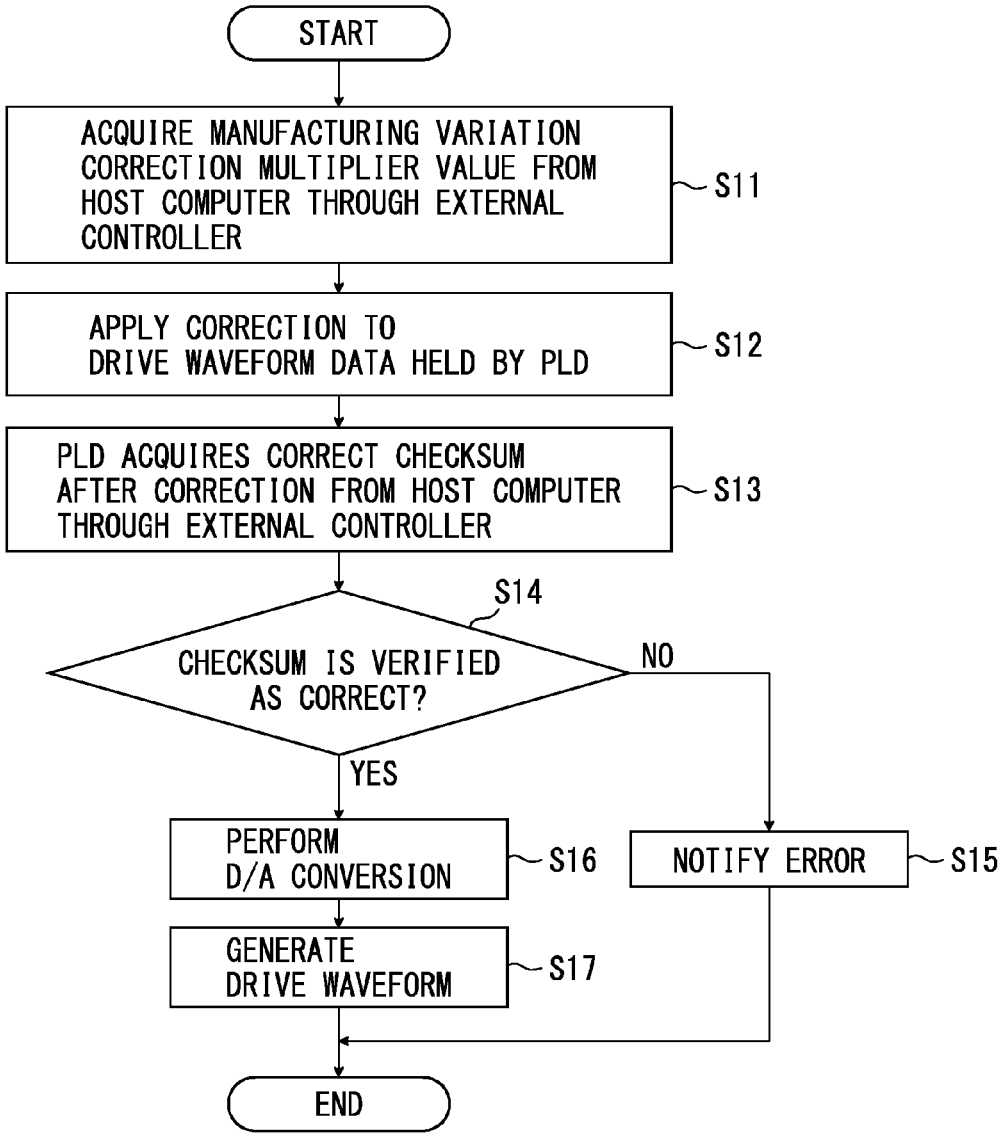
FIG. 10 is a flow chart showing processing for generating a drive waveform.

Next, processing for generating a drive waveform using the drive waveform data is described. FIG. 10 is a flow chart showing the processing for generating the drive waveform according to the present embodiment.

First, the PLD 304 acquires a manufacturing variation correction multiplier value of the head 250 to be driven from the host computer 286 through the communication interface 270 (step S11). The manufacturing variation correction multiplier value is for absorbing a variation in characteristics of the piezoelectric actuators due to a manufacturing variation of the head 250 by a drive waveform.

Moreover, while the correction multiplier value is acquired from the host computer 286 in this case, the correction multiplier value may be stored in advance in the reference memory which the print controller 280 is provided with.

Next, the PLD 304 multiplies the drive waveform data held in the memory 302 with the correction multiplier value acquired in step S11 (step S12). Accordingly, the drive waveform suited to each ink color can be generated regardless of the manufacturing variation of the head 250. In addition, the PLD 304 recomputes a checksum based on the drive waveform data after the correction.

Furthermore, the PLD 304 acquires a correct checksum after the correction from the host computer 286 through the communication interface 270 (step S13). Instead of acquiring the correct checksum after the correction from the host computer 286, the correct checksum after the correction may be computed by multiplying the checksum acquired in step S4 in FIG. 9 with the correction multiplier value acquired in step S12.

The checksum verification is made by comparing the checksum recomputed after multiplying with the correction multiplier value and the correct checksum after the correction acquired in step S13 (step S14).

An incorrect checksum means that the correction of manufacturing variation has been incorrectly performed. Therefore, the fact that the result is incorrect is notified to the host computer 286 and the processing is finished (step S15). When this notification is sent, the host computer 286 or the inkjet image forming apparatus 100 notifies the user that the error has occurred during the processing for correcting manufacturing variation. In this case, the user may retry from step S11.

When the checksum is verified as correct, the drive waveform data after the correction is D/A converted by the D/A converter 306 (step S16), and the drive waveform is generated by the head driver 284 (step S17).

More specifically, the PLD 304 reads the waveform value data beginning at the head at a predetermined frequency from the memory 302 and inputs the waveform value data to the D/A converter 306. The D/A converter 306 sequentially converts the inputted data into analog signals, which are then inputted to the head driver 284. Thereby, a waveform of a voltage corresponding to the waveform value data of the drive waveform data is generated at the head driver 284 and is inputted to each switch element 330 to be appliable to the individual electrode of each piezoelectric actuator 258.

Each switch element 330 is turned on and off according to the image data to be outputted, and controls driving of each piezoelectric actuator 258. Thus, the ink is ejected from the nozzle according to the image data and an image is formed on a recording medium.

In this case, a response speed of the operational amplifier 310 of the head driver 284 is significantly slower than a transfer speed of the drive waveform data (frequency of the output from the D/A converter 306). Then, since a data volume of the ID data inserted in the drive waveform data is sufficiently small, the drive waveform generation is not affected. Hence, the drive waveform generated by the drive waveform data in the present embodiment becomes the same waveform as in a case of inputting drive waveform data into which ID data is not embedded.

As described above, by embedding the ID data into the waveform value information, recognition of the drive waveform data can be achieved without increasing data volume. Moreover, since two or more pieces of ID data are included, the checksum verification can be performed and a transfer error of the drive waveform data or the like can be detected. Furthermore, since the ID data embedded in the waveform value information does not affect generation of the drive waveform, the drive waveform can be generated without increasing data throughput.

Second Embodiment

Figure 11:
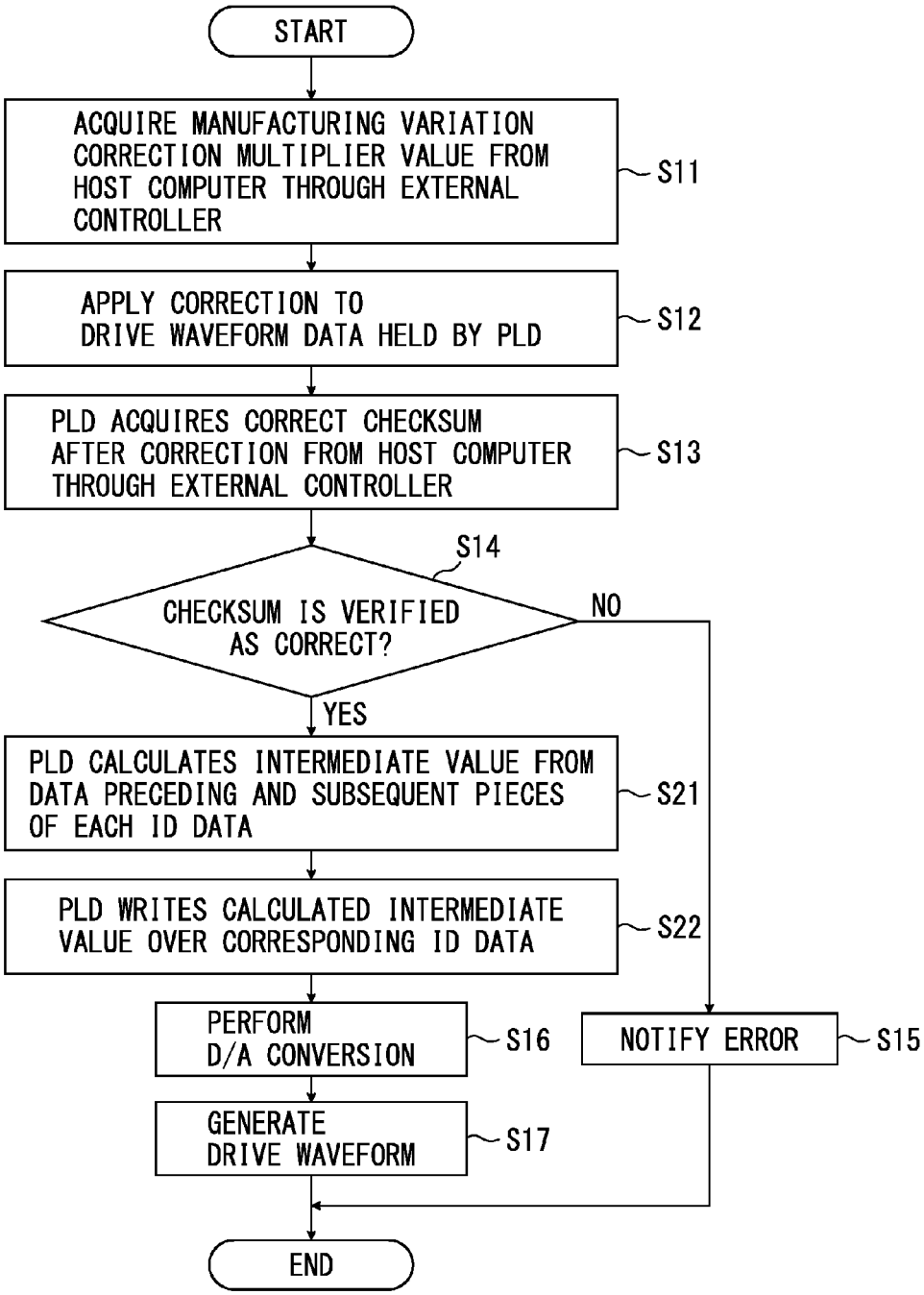
FIG. 11 is a flow chart showing processing for generating a drive waveform.

Next, processing for generating a drive waveform according to a second embodiment of the present invention is described. FIG. 11 is a flow chart showing the processing for generating the drive waveform according to the present embodiment. Portions that are the same with the flow chart shown in FIG. 10 are denoted with the same reference numerals and a detailed description thereof is hereby omitted.

First, the PLD 304 acquires the manufacturing variation correction multiplier value of the head 250 to be driven from the host computer 286 through the communication interface 270 (step S11), and multiplies the drive waveform data held in the memory 302 with the correction multiplier value (step S12).

Subsequently, the PLD 304 acquires the correct checksum after the correction from the host computer 286 through the communication interface 270 (step S13), and performs the checksum verification (step S14).

At this point, when the checksum is verified as correct, the PLD 304 interpolates waveform value data at the position where each piece of the ID data of the drive waveform data has been embedded, using preceding and subsequent pieces of waveform value data (step S21).

For example, assuming that the ID data "0x80" is recorded at a 100th piece of data from the head of the drive waveform data as shown in FIG. 12A. In this case, from the 99th piece of the waveform value data "0x20" and the 101st piece of the waveform value data "0x22", which are the preceding and subsequent pieces of the waveform value data, an intermediate value "0x21" is calculated and inserted at the 100th piece of the waveform value data as shown in FIG. 12B.

In addition, since the 0th and 1023rd pieces of the drive waveform data, which are the head and the tail of the drive waveform data, only have one of preceding and subsequent pieces of data, the same value as the one piece of data is used for the interpolation for the head or tail of the drive waveform data. For example, the 0th piece of the waveform value data is interpolated by assuming the same value as the 1st piece of the waveform value data "0x20", and similarly, the 1023rd piece of the waveform value data is interpolated by assuming the same value as the 1022nd piece of the waveform value data "0x20", as shown in FIG. 12B.

Reference again to FIG. 11, the waveform value calculated and interpolated in this manner is written over the ID data to generate drive waveform data interpolated over the ID data (step S22). The drive waveform data after the interpolation is stored in the memory 302 while being distinguished from the drive waveform data prior to the interpolation.

The drive waveform data after the interpolation is D/A converted by the D/A converter 306 (step S16), and the drive waveform is generated by the head driver 284 (step S17).

As described above, by calculating the waveform value of the position where the ID data has been embedded from the preceding and subsequent pieces of the waveform value data to reproduce the drive waveform data prior to embedding the ID data, the recognition and the interpolation of the waveform data can be performed without increasing the data volume of the drive waveform data. Moreover, by using the drive waveform data after the interpolation, a desired drive waveform can be generated even if the operational amplifier 310 has high response characteristics.

Applications to Other Apparatuses

While the embodiment of the application to the inkjet image forming apparatus for graphic printing has been described above, a scope of application of the present invention is not limited thereto. For example, the present invention can also be applied widely to inkjet systems which obtain various shapes or patterns using liquid function material, such as a wire printing apparatus, which forms an image of a wire pattern for an electronic circuit, manufacturing apparatuses for various devices, a resist printing apparatus, which uses resin liquid as a functional liquid for ejection, a color filter manufacturing apparatus, a fine structure forming apparatus for forming a fine structure using a material for material deposition, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording apparatus configured to drive a recording element to perform recording on a recording medium, the recording apparatus comprising:

a drive waveform data acquisition device configured to acquire drive waveform data which contain waveform value information for a plurality of predetermined periods of time of a drive waveform for driving the recording element and contain identification information of the drive waveform data embedded in at least two pieces of the waveform value information;

an identification information analysis device configured to extract the identification information from the drive waveform data and to interpret the extracted identification information;

a waveform generation device configured to receive the waveform value information for each of the predetermined periods of time of the drive waveform data and to generate the drive waveform according to the received waveform value information, the waveform value information for the predetermined periods of time of the drive waveform data being sequentially inputted to the waveform generation device; and a drive device configured to drive the recording element according to the drive waveform generated by the waveform generation device.

2. The recording apparatus as defined in claim 1, wherein the identification information is embedded in at least first and last pieces of the waveform value information.

3. The recording apparatus as defined in claim 1, wherein the identification information represents a value different from a bias value of the waveform value information.

4. The recording apparatus as defined in claim 1, further comprising:

a judgment device configured to judge, in accordance with an analysis result by the identification information analysis device, whether the acquired drive waveform data is normal; and a notification device configured to notify, when the verification device judges that the acquired drive waveform data is not normal, a user that the acquired drive waveform data is not normal.

5. The recording apparatus as defined in claim 4, wherein the judgment device includes an error detection device configured to perform error detection according to the identification information.

6. The recording apparatus as defined in claim 1, further comprising:

a plurality of recording elements corresponding respectively to colors to be recorded, wherein:

the identification information includes color information of each of the recording elements for which the drive waveform data are prepared; and the drive device drives each of the recording elements according to the color information interpreted by the identification information analysis device.

7. The recording apparatus as defined in claim 1, wherein the identification information includes version information of the drive waveform data.

8. The recording apparatus as defined in claim 1, wherein the waveform generation device has an output response characteristic in which the identification information is not reflected in the generated drive waveform.

9. The recording apparatus as defined in claim 1, further comprising a correction device which corrects the drive waveform data in order to absorb manufacturing variation of the recording element.

10. The recording apparatus as defined in claim 1, further comprising a reproduction device which reproduces waveform value information prior to embedment of the identification information.

11. A recording method of driving a recording element to perform recording on a recording medium, the method comprising the steps of:

acquiring drive waveform data which contain waveform value information for a plurality of predetermined periods of time of a drive waveform for driving the recording element and contain identification information of the drive waveform data embedded in at least two pieces of the waveform value information;

extracting the identification information from the drive waveform data, and interpreting the extracted identification information;

sequentially inputting the waveform value information for the predetermined periods of time of the drive waveform data to a waveform generation device, and generating the drive waveform by the waveform generation device according to the inputted waveform value information for each of the predetermined periods of time of the drive waveform data; and driving the recording element according to the drive waveform generated by the waveform generation device.

* * * * *